US006229256B1

(12) United States Patent
Suzuki et al.

(10) Patent No.: US 6,229,256 B1
(45) Date of Patent: May 8, 2001

(54) CATHODE RAY TUBE HAVING HIGH RESISTANCE FILM ON THE INNER WALL OF THE NECK

(75) Inventors: Fumihito Suzuki, Fukaya; Shigeru Sugawara, Saitama-ken; Takahiro Hasegawa, Gyoda, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/188,690

(22) Filed: Nov. 10, 1998

(30) Foreign Application Priority Data

Nov. 10, 1997 (JP) ..... 9-307119

(51) Int. Cl.[7] ..... H01J 31/00
(52) U.S. Cl. ..... 313/479; 313/450
(58) Field of Search ..... 313/479, 450, 313/414, 412; 315/3

(56) References Cited

U.S. PATENT DOCUMENTS

| | | | |
|---|---|---|---|
| 3,355,617 | 11/1967 | Schwartz et al. | 313/82 |
| 4,280,931 | 7/1981 | Delsing et al. | 252/518 |
| 4,473,774 | 9/1984 | Hernqvist | 313/479 |
| 4,518,893 | 5/1985 | Kane et al. | 313/479 |
| 4,977,348 * | 12/1990 | Odenthal | 313/479 |
| 5,536,997 * | 7/1996 | Van Hout | 313/479 |

FOREIGN PATENT DOCUMENTS

| | | |
|---|---|---|
| 26 34 102 | 2/1977 | (DE) . |
| 27 49 211 | 5/1978 | (DE) . |
| 27 12 711 | 9/1978 | (DE) . |
| 387 020 | 9/1990 | (EP) . |
| 10-134739 | 5/1998 | (JP) . |

* cited by examiner

*Primary Examiner*—Nimeshkumar D. Patel
*Assistant Examiner*—Karabi Guharay
(74) *Attorney, Agent, or Firm*—Pillsbury Winthrop LLP

(57) ABSTRACT

A cathode ray tube according to the invention comprises an internal conductive film arranged on the inner wall surface of the envelope and extending from the funnel section to the neck section and a high resistance conductive film arranged in the neck section to contact the internal conductive film at an end of thereof and surround part of the electron gun assembly. The high resistance conductive film shows an electric resistance higher than that of the internal conductive film. Additionally, in a cathode ray tube according to the invention, the electric resistance of the high resistance conductive film in terms of per unit length along the axis of the tube is lower at and near the contact region held in contact with the corresponding end of the internal conductive film than at and near the opposite end of the high resistance conductive film.

6 Claims, 3 Drawing Sheets

| | | |
|---|---|---|
| | 31 | 26 |
| | CONDITION A | CONDITION B |

CATHODE RAY TUBE HAVING HIGH RESISTANCE FILM ON THE INNER WALL OF THE NECK

BACKGROUND OF THE INVENTION

This invention relates to a cathode ray tube such as a color cathode ray tube and, more particularly, it relates to the state of the high resistance conductive film applied to the inner wall surface of the neck of a cathode ray tube.

Generally, a color cathode ray tube comprises an envelope having a panel, a funnel and a neck constructed as integral parts thereof. The panel carries on the inner surface thereof a fluorescent screen (target) having three stripe-shaped or dot-shaped fluorescent layers that fluoresce respectively in blue, green and red. The panel also has therein a shadow mask provided with a large number of apertures and arranged vis-a-vis the fluorescent screen.

The neck contains therein an electron gun assembly. The electron gun assembly is adapted to emit three electron beams that proceed on a same horizontal plane and include a center beam and a pair of side beams. The three electron beams emitted from the electron gun assembly are converged toward the fluorescent screen and focused on the respective fluorescent layers of blue, green and red.

A deflection yoke arranged on the outside of the funnel produces a non-uniform magnetic field for deflecting the three electron beams emitted from the electron gun assembly in horizontal and vertical directions. Thus, the three electron beams emitted from the electron gun assembly are forced to scan the fluorescent screen both horizontally and vertically by way of the shadow mask by the non-uniform magnetic field. As a result, a color image is displayed on the screen.

Referring to FIG. 1 of the accompanying drawings, the color cathode ray tube has an internal conductive film 7 formed on the inner surface of the envelope and extending from the funnel to the neck 3. The internal conductive film 7 is electrically connected to the anode terminal arranged on the funnel. On the other hand, the convergence electrode 9 of the electron gun assembly 8 is electrically connected to the internal conductive film 7 by way of a bulb spacer 10. Thus, the anode voltage supplied from the anode terminal is applied to the convergence electrode 9 by way of the internal conductive film 7 and the bulb spacer 10.

However, in a color cathode ray tube having a configuration as described above, the converging performance of the three electron beams may change as the electric potential of the inner wall surface of the neck 3 changes with time. As a result, the three electron beams may not land on the respective fluorescent layers to give rise to a problem of color deviations in the displayed image.

More specifically, the problem occurs in the following manner.

Since the neck is made of an insulator material, or glass for instance, it is apt to become electrically charged and then discharge the accumulated electric charge. Therefore, the potential of the electric charge of the inner wall surface of the neck, i.e. the neck potential, comes to show a predetermined potential distribution pattern immediately after the application of the anode voltage under the influence of various components including the internal conductive film 7 and the convergence electrode 9 of the electron gun assembly 8.

However, as time goes on, stray electrons generated within the neck eventually collide with the inner wall surface of the neck, thereby causing secondary electrons to be emitted from the inner wall surface, and gradually raise the neck potential. As a result, the neck potential changes with time.

The neck potential affects the electric field operating as main electron lens section of the electron gun assembly. Then, as the neck potential is not stably held to a constant level but rises with time, it gradually but remarkably permeates into the electric field of the main electron lens section. Thus, in the course of time, the neck potential changes the distribution of the electric field operating as main electron lens section. Since the neck potential permeates into the main electron lens section from the periphery thereof, it alters the tracks of the two side beams passing through a peripheral area of the main electron lens section.

Thus, color deviations occur in a color cathode ray tube adapted to emit three electron beams because of the phenomenon of the change with time of the converging performance of the electron beams, which is referred to as convergence drift.

Japanese Patent Applications KOKAI Publication Nos. 64-12449 and 5-205560 propose the use of a high resistance conductive film 17 having a coefficient of electron emission smaller than one and arranged on the inner surface of the neck as shown in FIG. 1. The high resistance conductive film 17 is directly arranged on the inner wall surface of the neck and held in contact with the internal conductive film 7. As a result, it can prevent the change with time of the neck potential due to the emission of secondary electrons of the neck and suppress color deviations due to convergence drift.

However, when a high resistance conductive film is arranged on the inner surface of the neck and held in contact with the internal conductive film in a manner as described in Japanese Patent Applications KOKAI Publication Nos. 64-12449 and 5-205560 and if the high resistance conductive film has a uniform film thickness as seen from FIG. 1, a problem arises as described below.

Referring to FIG. 1, if the central axis of the neck which is the axis of the tube is Z-axis, the resistance of the high resistance conductive film 17 per unit length of the Z-axis is constant. Additionally, since the neck potential is relatively high if compared with its counterpart of a cathode ray tube having no high resistance conductive film 17, a phenomenon of field emission is apt to occur between any metal part of the electron gun assembly 8, which may be an electrode, and the inner wall surface of the neck to give rise to a problem of reduced withstand voltage.

BRIEF SUMMARY OF THE INVENTION

In view of the above identified problem, it is therefore the object of the present invention to provide a cathode ray tube comprising a high resistance conductive film arranged on the inner wall surface of the neck to suppress any convergence drift and adapted to show an withstand voltage that is sufficiently high to effectively suppress a field emission that can occur between a metal part of the electron gun assembly, which may be an electrode, and the inner wall surface of the neck.

According to the invention, the above object is achieved by providing a cathode ray tube comprising;

- an electron gun assembly for emitting a plurality of electron beams arranged in a row to proceed on a same horizontal plane and focusing on a target;
- a deflection yoke for generating a deflection magnetic field to deflect the plurality of electron beams emitted from the electron gun assembly into a horizontal direction and a vertical direction, the horizontal direction and the vertical direction being rectangular relative to each other on the target;

an envelope having a neck section for containing the electron gun assembly, a panel section provided with the target and a funnel section having its inner diameter increasing from the neck section toward the panel section;

an internal conductive film arranged on the inner wall surface of the envelope and extending from the funnel section to the neck section; and a high resistance conductive film arranged in the neck section so as to be held in contact with an end portion of the internal conductive film on the inner wall surface of the neck section and surround at least part of the electron gun assembly from the end portion, the high resistance conductive film having an electric resistance higher than that of the internal conductive film; characterized in that:

the film resistance of the high resistance conductive film per unit length of the axis of the tube running perpendicularly relative to the horizontal direction and the vertical direction is lower in a contact region located at an end of the high resistance conductive film and held in contact with the end portion of the internal conductive film than in a region located at the other end portion of the high resistance conductive film.

In a cathode ray tube according to the invention, a high resistance conductive film having an electric resistance higher than the internal conductive film is formed on the inner wall surface of the neck section, extending from a position where it contact an end portion of the internal conductive film to part of the area where the electron gun assembly is arranged. Thus, it suppresses the emission of secondary electrons from the neck section and prevents any undesired change with time of the neck potential. As a result, the adverse effect of the change in the neck potential on the tracks of the electron beams in the cathode ray tube can be minimized and any possible color deviations of the displayed image due to the phenomenon of convergence drift can be prevented effectively.

Additionally, since the film resistance of the high resistance conductive film per unit length of the axis of the tube is lower in a contact region located at and near an end portion of the high resistance conductive film than in a region located at and near the other end portion of the high resistance conductive film, the electric potential of the inner wall surface of the neck section can be held to a relatively low level. Thus, any field emission that can occur between a metal part of the electron gun assembly, which may be an electrode, and the inner wall surface of the neck can be effectively suppressed.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Now, the present invention will be described in greater detail by referring to the accompanying drawings that illustrate a preferred embodiment of cathode ray tube according to the invention, which is a color cathode ray tube.

Figure 2:
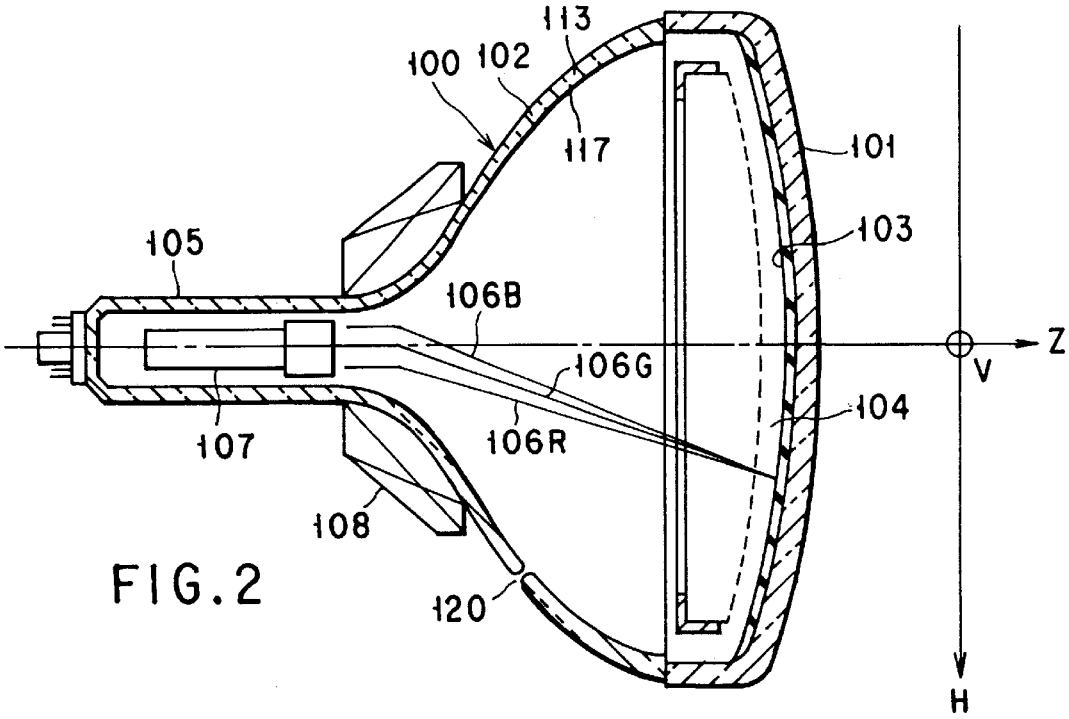
FIG. 2 is a schematic horizontal cross sectional view of a color cathode ray tube according to the invention.

FIG. 2 is a schematic cross sectional view of the embodiment of cathode ray tube according to the invention, which is a color cathode ray tube. Referring to FIG. 2, the color cathode ray tube comprises an envelope 100 having a panel section 101, a funnel section 102 and a neck section 105 constructed together as integral parts thereof. The panel section 101 carries on the inner surface thereof a fluorescent screen 103 (target) having three stripe-shaped or dot-shaped fluorescent layers that fluoresce respectively in red (R), green (G) and blue (B). The panel section 101 also has therein a shadow mask 104 provided with a large number of apertures and arranged vis-a-vis the fluorescent screen 103.

The neck section 105 has a hollow cylindrical profile and thus a circular cross section. It contains therein an in-line type electron gun assembly 107. If the central axis of the neck section 105 i.e. the axis of the tube is Z-axis and a horizontal axis and a vertical axis perpendicular to the Z-axis are H-axis and V-axis respectively, the in-line type electron gun assembly 107 is adapted to emit three electron beams 106B, 106G, 106R that proceed on a same horizontal plane, i.e. H-Z plane, defined by the H-axis and the Z-axis. The three electron beams include a center beam 106G and a pair of side beams 106B, 106R arranged in a row on a plane along the H-axis. The three electron beams 106 (R, GI B) emitted from the electron gun assembly 107 are converged toward the fluorescent screen 103 and focused on the respective fluorescent layers of blue, green and red.

A deflection yoke 108 is arranged on the outside of the funnel section 102 and produces a non-uniform magnetic field for deflecting the three electron beams 106 (R. G, B) emitted from the electron gun assembly 107 in the horizontal direction H and the vertical direction V. The non-uniform magnetic field comprises a pin-cushion type horizontal deflecting magnetic field and a barrel type vertical deflecting magnetic field.

The color cathode ray tube further comprises an external conductive film 113 formed on the outer wall surface of the funnel section 102 and an internal conductive film 117 formed on the inner wall surface of the envelope extending from the funnel section 102 to the neck section 105. The internal conductive film 117 is electrically connected to an anode terminal 120 for supply an anode voltage.

In a color cathode ray tube having a configuration as described above, the three electron beams 106 (R, G, B) emitted from the electron gun assembly 107 are forced to scan the fluorescent screen 103 both horizontally and vertically by way of the shadow mask 104 by the non-uniform magnetic field produced by the deflection yoke 108. As a result, a color image is displayed on the screen 103.

Figure 3:
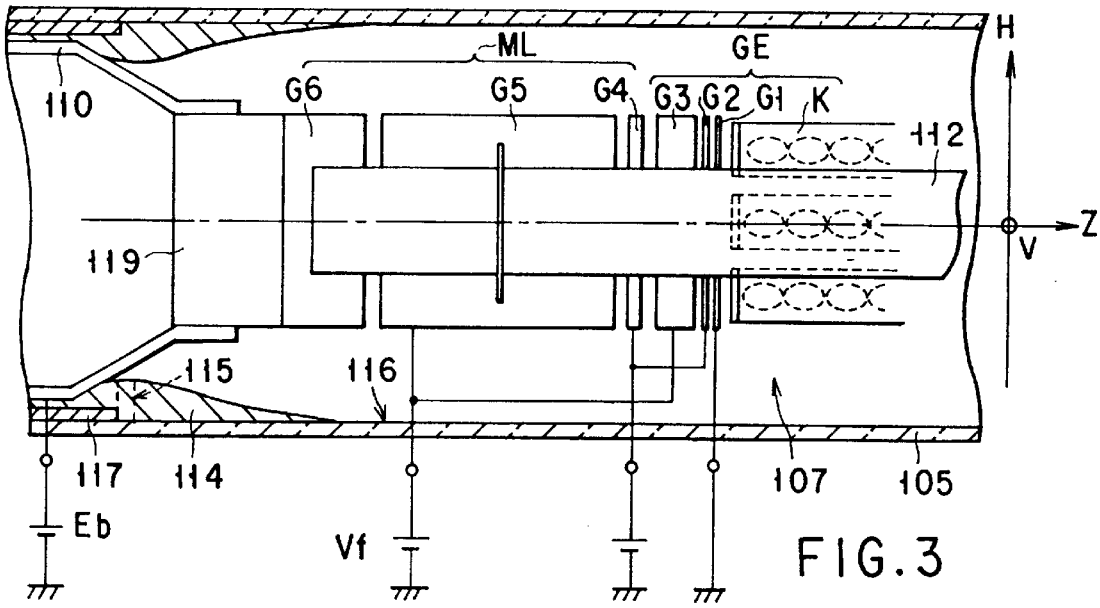
FIG. 3 is a schematic plan view of the neck section of the cathode ray tube of FIG. 2, showing its structure.

FIG. 3 is a schematic plan view of the neck section of the cathode ray tube of FIG. 2, showing its structure. Note that, in FIG. 3, the Z-axis has a positive direction that is reverse relative to the direction along which the electron beams proceed.

Referring to FIG. 3, the color cathode ray tube comprises an in-line type electron gun assembly 107 arranged within the neck section 105. The electron gun assembly 107 has three cathodes K for emitting three electron beams 106B, 106G, 106R arranged in a row in line with a plane running along the H-axis and three heaters for heating the respective cathodes K independently.

The electron gun assembly 107 additionally has first through sixth grids G1 through G6 arranged sequentially at regular intervals in a direction directed from cathodes K toward the fluorescent screen (target) or the negative direction of the Z-axis and a convergence electrode 119 fitted to the end of the sixth grid G6 located close to the fluorescent screen. Each of the first and second grids G1, G2 comprises a plate-shaped electrode, whereas each of the third through sixth grids G3 through G6 comprises a cylindrical electrode.

The heaters, the cathodes K and the first through sixth grids G1 through G6 are supported by a pair of insulator supports, or bead glass plates 112, disposed oppositely in the vertical direction V that is perpendicular to the horizontal direction H. The bead glass plates 112 extends along the direction Z of the axis of the tube as shown in FIG. 3.

Both the first and second grids G1, G2 have three relatively small and substantially circular through holes arranged in a row along the horizontal direction H to allow electron beams to pass through.

The third grid G3 has three substantially circular through holes arranged in a row along the horizontal direction H to allow electron beams to pass through. The through holes faces both the second grid G2 and the fourth grid G4. The through holes of the third grid G3 have a diameter greater than that of the through holes of the second grid G2.

The fourth grid G4 has three substantially circular through holes arranged in a row along the horizontal direction H to allow electron beams to pass through. The through holes faces both the third grid G3 and the fifth grid G5. The through holes of the fourth grid G4 have a diameter greater than that of the through holes formed on the side facing the fourth grid G4 of the third grid G3.

The fifth grid G5 has three substantially circular through holes arranged in a row along the horizontal direction H to allow electron beams to pass through. The through holes faces both the fourth grid G4 and the sixth grid G6. The through holes of the fifth grid G5 have a diameter substantially equal to that of the through holes formed on the side facing the fifth grid G5 of the fourth grid G4.

The sixth grid G6 has three substantially circular through holes arranged in a row along the horizontal direction H to allow electron beams to pass through. The through holes faces both the fifth grid G5 and convergence electrode 119. The through holes of the sixth grid G6 have a diameter substantially equal to that of the through holes formed on the side facing the sixth grid G6 of the fifth grid G5.

The convergence electrode 119 has three substantially circular through holes arranged in a row along the horizontal direction H on the bottom, or the side facing the sixth grid G6 to allow electron beams to pass through. The through holes of the convergence electrode 119 have a diameter substantially equal to that of the through holes of the sixth grid G6. Additionally, the convergence electrode 119 is electrically connected via a bulb spacer 110 to the internal conductive film 117, to which anode voltage Eb is supplied.

Now, the electric connections of the grids of the electron gun assembly will be described by referring to FIG. 3.

The cathodes K of the electron gun assembly are electrically connected to a DC power source and a video signal source (not shown). A voltage obtained by adding a video signal to a 100 to 200V DC voltage is applied to the cathodes K. The first grid G1 is grounded.

The second grid G2 and the fourth grid G4 are connected with each other within the tube and also to a DC power source. A voltage of about 500 to 1000V is applied to the second grid G2 and the fourth grid G4.

The third grid G3 and the fifth grid G5 are connected with each other within the tube and also to a DC power source. A DC voltage Vf equal to about 20 to 35% of the anode voltage Eb which is applied to the sixth grid G6 is applied to the third grid G3 and the fifth grid G5.

The anode voltage Eb equal to about 25 to 35 kV is applied to the sixth grid G6 by way of the bulb spacer 110 and the internal conductive film 117.

With the electron gun assembly, an electron beam generator GE is constructed by the cathodes K and the first through third grids G1 through G3 as the above voltages are applied to the respective grids. The electron beam generator GE controls the emission of electrons from the cathodes K and produces electron beams by accelerating and focusing the emitted electrons.

A main electron lens section ML is constructed by the third through sixth grids G3 through G6. The main electron lens section ML accelerates and focuses the electron beams produced by the electron beam generator GE on the fluorescent screen.

Meanwhile, the color cathode ray tube has a high resistance conductive film 114 arranged on the inner wall surface extending from the funnel section 102 to the neck section as shown in FIG. 3. The high resistance conductive film 114 has an electric resistance higher than that of the internal conductive film 117. The high resistance conductive film 114 has a contact region 115 at and near an end thereof that contacts the internal conductive film 117, being arranged on the inner wall surface of the neck section 105 so as to cover part of the electron gun assembly 107. The other end 116 of the high resistance conductive film 114 reaches the main electron lens section ML of the electron gun assembly 107.

The high resistance conductive film 114 is produced by applying a solution that is prepared by dispersing antimony-doped tin oxide (ATO) which is an electrically conductive oxide and a silane-type coupling agent such as ethyl silicate operating as binder in an organic solvent such as ethyl alcohol to the inner wall surface of the neck section 105 and then drying it. The solution is applying by means of dispensing, spraying, dipping, and so on. A high resistance conductive film 114 formed in this manner shows a very small film thickness, which is typically less than 1 $\mu$m.

The high resistance conductive film 114 remarkably suppress any convergence drift that change with time the convergent particularity of the electron beams.

More specifically, immediately after applying the anode voltage Eb, the electric potential of the neck section, i.e. the neck potential, comes to show a predetermined potential distribution pattern under the influence of various components including the internal conductive film 117 and the convergence electrode 9 of the electron gun assembly 107. Thereafter, secondary electrons are discharged from the neck section 105 as stray electrons generated within the neck section 105 collide with the inner wall surface of the neck section 105. The neck potential rises as secondary electrons are released from the neck section 105. Then, as the neck potential rises with time, it gradually but remarkably permeates into the electric field of the main electron lens section ML of the electron gun assembly 107 from the inner wall surface of the neck section to affect the electric field operating as the main electron lens section ML. Thus, in the course of time, the distribution pattern of the electric field operating as the main electron lens section ML is deformed by the neck potential to eventually swerve the two side electron beams from their proper tracks. As a result, the convergence of the three electron beams changes with time to give rise to color deviations in the displayed image.

However, the high resistance conductive film 114 arranged on the inner wall surface of the neck section 105 of this embodiment can effectively suppress the discharge of secondary electrons and prevent any possible color deviations due to convergence drift.

Additionally, the high resistance conductive film 114 shows a film resistance per unit length in the direction of the Z-axis that is higher in the contact region 115 located at and near the end of the high resistance conductive film 114 that contacts with the internal conductive film 117 than in the region 116 located at and near the other end 116 of the high resistance conductive film 114.

In other words, the film resistance of the high resistance conductive film 114 gradually rises from the contact region 115 contacting an end of the internal conductive film 117 toward the other end 116 of the high resistance conductive film 114. The film resistance becomes highest on the other end 116. Conversely, the film resistance of the high resistance conductive film 114 gradually falls from the end 116 of the high resistance conductive film 114 located remotely from the internal conductive film 117 toward the contact region 115. The film resistance becomes lowest on the contact region 115.

Such a distribution pattern of film resistance can typically be realized by forming the high resistance conductive film 114 with a varying film thickness as in the case of this embodiment.

Referring to FIG. 3, the high resistance conductive film 114 has a film thickness that is greater in the contact region 115 located at and near the end thereof contacting the internal conductive film 114 than at and near the opposite end 116.

In other words, the film thickness of the high resistance conductive film 114 gradually decreases from the region 115 toward the other end 116. The film thickness is smallest on the other end 116. Conversely, the film thickness of the high resistance conductive film 114 gradually increases from the other end 116 toward the contact region 115. The film thickness is largest on the contact region 115.

Thus, the neck potential can be relatively held low by producing such a film resistance distribution pattern. It is now possible to suppress any field emission that may appear between the metal parts such as the grid G5 to which the focus voltage is applied and the neck section 105 of the embodiment.

In an experiment, the neck potential of a color cathode ray tube according to the invention and comprising a high resistance conductive film having a film resistance distribution pattern as described above was simulated. Additionally, in the experiment, the neck potential of color cathode ray tube CRT1 showing the film resistance distribution patter of this embodiment, that of color cathode ray tube CRT2 showing a uniform film resistance distribution pattern and that of color cathode ray tube CRT 3 having no high resistance conductive film were compared.

Figure 1:
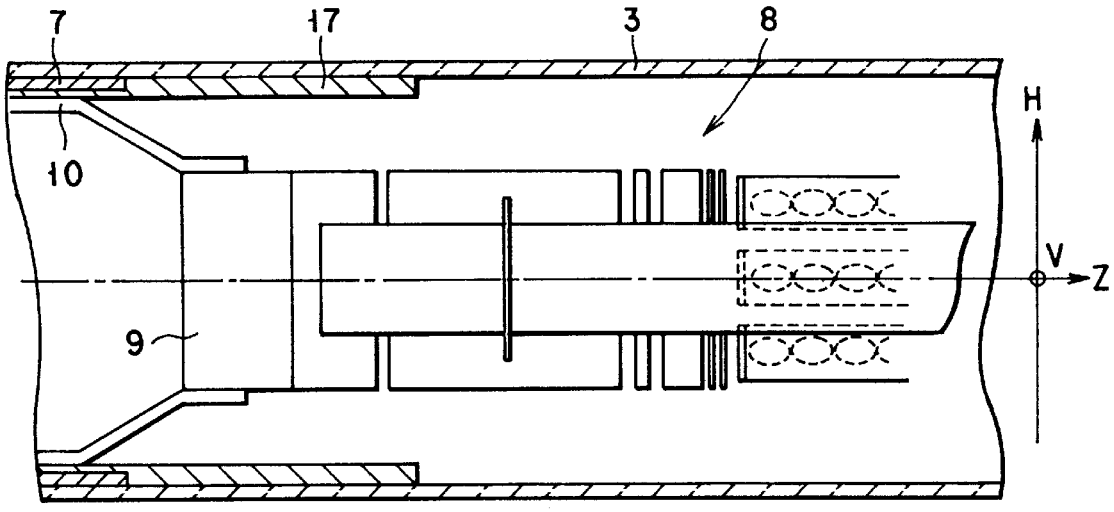
FIG. 1 (PRIOR ART)
FIG. 1 is a schematic plan view of the neck section of a known cathode ray tube, showing its structure.
Figure 4A:
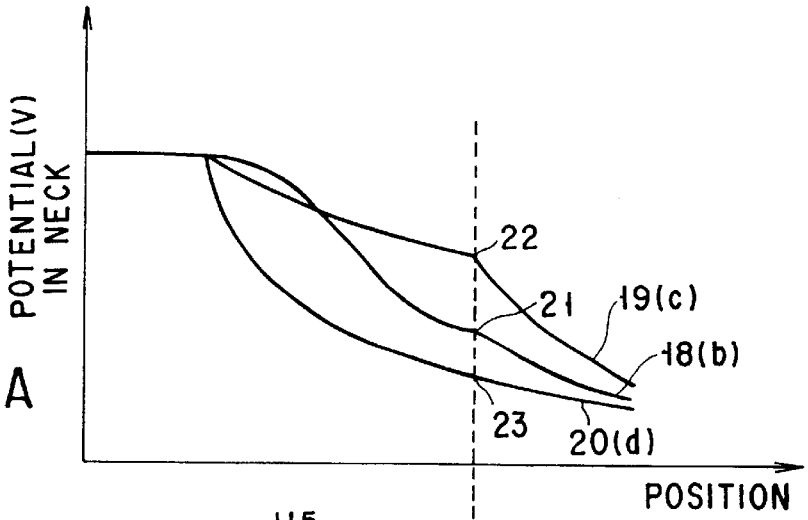
FIG. 4A is a graph of the neck potential obtained as a result of a simulating operation.
Figure 4B:
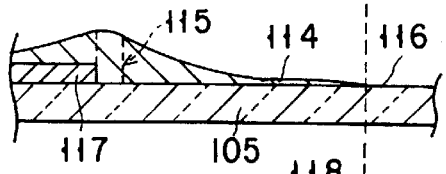
FIG. 4B is a schematic cross sectional partial view of the color cathode ray tube of FIG. 3, showing how a high resistance conductive film is applied thereto.
Figure 4C:
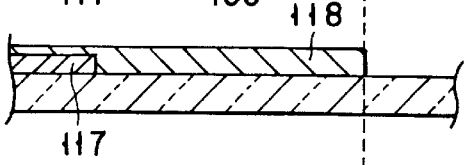
FIG. 4C is a schematic cross sectional partial view of the color cathode ray tube of FIG. 1, also showing how a high resistance conductive film is applied thereto.
Figure 4D:
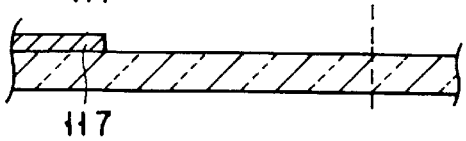
FIG. 4D is a schematic cross sectional partial view of the color cathode ray tube in an area located at and near an end of the internal conductive film.

FIG. 4A shows the simulated neck potentials of each of the color cathode ray tubes CRT1, CRT2, and CRT3. In the graph of FIG. 4A, the axis of abscissa represents the Z-axis of the tube having a positive direction that is reverse relative to the direction along which the electron beams proceed and the axis of ordinate represents the relative value of the neck potential calculated along the Z-axis. FIG. 4B is a schematic cross sectional partial view of the color cathode ray tube CRT1 having a configuration as illustrated in FIG. 3, showing how a high resistance conductive film 114 is applied thereto. FIG. 4C is a schematic cross sectional partial view of the color cathode ray tube CRT2 having a configuration as illustrated in FIG. 1, also showing how a high resistance conductive film 118 is applied thereto. FIG. 4D is a schematic cross sectional partial view of the color cathode ray tube CRT3 in an area located at and near an end of the internal conductive film 117.

In FIG. 4A, distribution curves 18(*b*), 19(*c*), 20(*d*) are respectively for the simulated neck potential of the color cathode ray tubes CRT1, CRT2 and CRT3.

The neck potential 21 of the high resistance conductive film 114 having a profile as shown in FIG. 4B is lower at and near the other end 116 of the high resistance conductive film 114 than the neck potential 22 of the color cathode ray tube CRT2 having a high resistance conductive film 118 with a uniform film thickness as shown in FIG. 4C and approximately as low as the neck potential 23 of the color cathode ray tube CRT3 having no high resistance conductive film. Additionally as shown in FIG. 4A, the neck potential of the color cathode ray tube CRT1 comes closer to that of the color cathode ray tube CRT3 as the point of observation moves away from the internal conductive film 117 along the Z-axis.

Thus, the potential difference between the metal parts such as the electrodes arranged in the electron gun assembly to which the focus voltage is applied and the region at and near the other end 116 of the high resistance conductive film is lower in the color cathode ray tube CRT1 than in the color cathode ray tube CRT2. In other words, the potential difference between the electrodes of the electron gun assembly to which the focus voltage is applied and the portion of the high resistance conductive film located close to the electrodes is approximately as small as the corresponding potential difference of the color cathode ray tube CRT3 having no high resistance conductive film.

Therefore, the high resistance conductive film can effectively suppress any convergence drift and also any field emission that may occur between the metal parts of the electron gun assembly such as electrodes and the inner wall surface of the neck.

Now, the advantage in the withstand voltage of a color cathode ray tube having a configuration as shown in FIG. 3 will be described by referring to the data obtained in an experiment.

Figures 5, 6:
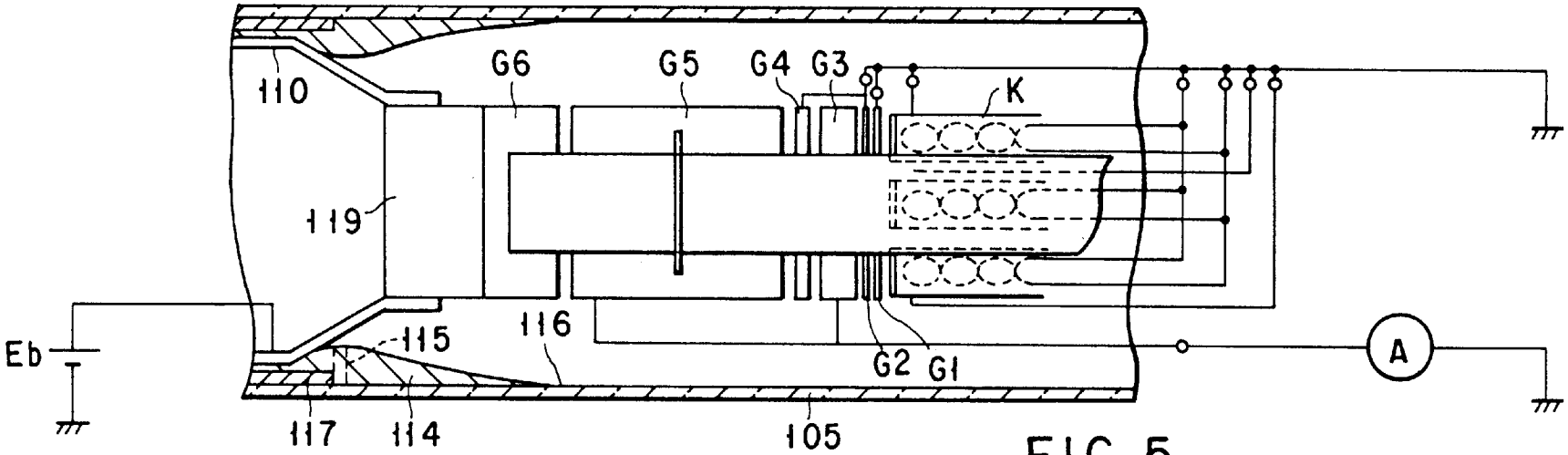
FIG. 5 is a schematic circuit diagram of a circuit adapted to observe field emission.
FIG. 6 is a chart showing the voltage of the anode voltage source that was observed when the electric current flowing to the ammeter A in the circuit of FIG. 5 was 0.01 $\mu$A.

FIG. 5 is a schematic circuit diagram of a circuit adapted to observe the withstand voltage of the color cathode ray tube CRT1 having a film resistance distribution pattern as described above. The withstand voltage is determined by the voltage when a field emission is observed.

The voltage of the anode voltage source was observed as withstand voltage when the electric current flowing to the ammeter A marked 0.01 $\mu$A due to field emission by means of the circuit of FIG. 5. The neck section 105 of the color cathode ray tube observed in this experiment had an outer diameter of 22.5 mm. FIG. 6 shows the obtained result. Note that the voltage shown in FIG. 6 is the average of a total of 10 measurements.

Referring to FIG. 6, condition A corresponds to the color cathode ray tube CRT1 of this embodiment, whereas condition B corresponds to the known color cathode ray tube CRT2 as shown in FIG. 1. As seen from FIG. 6, the voltage of the anode voltage source of the color cathode ray tube CRT1 of this embodiment was 31 kV when a field emission occurred. On the other hand, the voltage of the anode voltage source of the known color cathode ray tube CRT2 was 26 kV when a field emission occurred. Thus, the voltage of the color cathode ray tube CRT1 of this embodiment was higher than its counterpart of the known color cathode ray tube CRT2 as observed when a field. emission occurred. Thus, a cathode ray tube according to the invention and having a configuration as shown in FIG. 4B is more advantageous than a known cathode ray tube in terms of withstand voltage.

As described, a cathode ray tube according to the invention comprises an internal conductive film 117 arranged on the inner wall surface of the envelope and extending from the funnel section 102 to the neck section 105 and a high resistance conductive film 114 arranged in the neck section 105 to contact the end of the internal conductive film 117 and cover part of the electron gun assembly 107. The high resistance conductive film 114 shows an electric resistance higher than that of the internal conductive film 117.

Thus, any emission of secondary electrons from the neck section 105 is effectively suppressed to prevent color deviations from occurring due to convergence drift.

Additionally, in a cathode ray tube according to the invention, the electric resistance of the high resistance conductive film 114 in terms of per unit length along the axis of the tube is lower at and near the contact region 115 held in contact with the end of the internal conductive film 117 than at and near the opposite end 116 of the high resistance conductive film 114.

As a result, the electric potential of the inner wall surface of the neck section 105 can be held to a relatively low level and hence any possible field emission that may occur between the metal parts of the electron gun assembly to which a high voltage is applied and the inner wall surface of the neck section 105 can effectively be suppressed.

Thus, as described above in detail, the present invention provides a cathode ray tube comprising a high resistance conductive film arranged on the inner wall surface of the neck section to suppress any convergence drift and also any field emission that may occur between the metal parts of the electron gun assembly such as electrodes and the inner wall surface of the neck. Such a cathode ray tube shows an excellent withstand voltage.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. A cathode ray tube comprising;

an electron gun assembly for emitting a plurality of electron beams arranged in a row to proceed on a same horizontal plane and focusing on a target;

a deflection yoke for generating a deflection magnetic field to deflect the plurality of electron beams emitted from the electron gun assembly into a horizontal direction and a vertical direction, said horizontal direction and said vertical direction being perpendicular to each other on the target;

an envelope having a neck section for containing said electron gun assembly, a panel section provided with said target and a funnel section having its inner diameter increasing from the neck section toward the panel section;

an internal conductive film arranged on the inner wall surface of the envelope and extending from said funnel section to said neck section; and a high resistance conductive film arranged in said neck section so as to be held in contact with an end portion of said internal conductive film on the inner wall surface of said neck section and surround at least part of said electron gun assembly from the end portion, said high resistance conductive film having an electric resistance higher than that of said internal conductive film; characterized in that:

the film resistance of said high resistance conductive film per unit length of the axis of the tube running perpendicularly relative to said horizontal direction and said vertical direction is lower in a contact region located at an end portion of said high resistance conductive film and held in contact with said end portion of the internal conductive film than in a region located at the other end portion of said high resistance conductive film.

2. The cathode ray tube according to claim 1, wherein said film resistance of said high resistance conductive film is lowest in said contact region and highest in the region located at said other end portion.

3. The cathode ray tube according to claim 1, wherein said film resistance of said high resistance conductive film gradually decreases from said other end portion toward said contact region held in contact with said internal conductive film.

4. The cathode ray tube according to claim 1, wherein said high resistance conductive film has an axial cross section, such that said contact region is thicker than said other end portion.

5. The cathode ray tube according to claim 4, wherein said high resistance conductive film has a film thickness that is largest at said contact region and smallest at said other end portion.

6. The cathode ray tube according to claim 4, wherein said high resistance conductive film has a film thickness that gradually increases from said other end portion toward said contact region held in contact with said internal conductive film.

* * * * *